United States Patent [19]

Kessler

[11] Patent Number: 4,811,767

[45] Date of Patent: Mar. 14, 1989

[54] PROTECTIVE COVER FOR SWIMMING POOL PUMP AND FILTER ASSEMBLIES

[76] Inventor: Emerich Kessler, 28 Lakeview Dr., West Orange, N.J. 07052

[21] Appl. No.: 121,677

[22] Filed: Nov. 17, 1987

[51] Int. Cl.[4] ..... B65D 65/04

[52] U.S. Cl. ..... 150/154; 150/901

[58] Field of Search ..... 150/52 R

[56] References Cited

U.S. PATENT DOCUMENTS

| | | | |
|---|---|---|---|
| 2,705,990 | 4/1955 | Miller | 150/52 R |
| 2,707,620 | 5/1955 | Snyder | 150/52 R |
| 3,506,049 | 4/1970 | Gerard | 150/52 R |
| 3,674,073 | 7/1972 | Hendon | 150/52 R |
| 4,091,149 | 5/1978 | Oxendine | 428/33 |
| 4,206,575 | 6/1980 | Leonard | 52/3 |
| 4,296,558 | 10/1981 | Antonious | 36/50 |
| 4,573,573 | 3/1986 | Favaro | 150/52 R |
| 4,573,991 | 3/1986 | Pieniak et al. | 604/38.5 A |
| 4,622,137 | 11/1986 | Kessler | 210/169 |
| 4,639,035 | 1/1987 | Isaacson | 296/218 |
| 4,657,673 | 4/1987 | Kessler | 210/108 |
| 4,682,447 | 7/1987 | Osborn | 52/3 |

*Primary Examiner*—William Price

*Attorney, Agent, or Firm*—Morgan & Finnegan

[57] ABSTRACT

A substantially weather-proof, protective cover which can be easily installed and removed and which is adapted to protect a swimming pool pump and filter assembly is provided. The cover is comprised of a plurality of separate pieces which when assembled and joined to each other form a unitary body which conforms substantially to the shape of the swimming pool pump and filter assembly. The cover includes: (1) a weather proof, outer layer, e.g., a marine vinyl layer which is sized to fit snugly around and substantially enclose the pump and filter assembly; (2) a mesh border affixed to the bottom edge of the outer layer; and (3) means located in the mesh border for securing the cover around the pump and filter assembly. The cover may also include: (4) sealable access means such as a zipper in the outer layer providing access to the pump and filter assembly.

7 Claims, 1 Drawing Sheet

PROTECTIVE COVER FOR SWIMMING POOL PUMP AND FILTER ASSEMBLIES

BACKGROUND OF THE INVENTION

1. Field of the Invention

The present invention relates to protective covers. More particularly, the present invention relates to protective covers which are custom fitted to swimming pool pump and filter assemblies.

2. Background of the Invention

Swimming pools are normally equipped with pump and filter assemblies, and heating assemblies to keep the pool water clear and to heat the same. Pump and filter assemblies are well known and are described, for example, in U.S. Pat. Nos. 4,622,137 and 4,657,673 to E. Kessler. Frequently, such pool pump and filter assemblies or pool heating assemblies are installed alongside the pool or elsewhere out of doors and are exposed to splashing from the pool or the harmful effects of the weather. Many of the moving and non-moving parts of such assemblies are made of materials which tend to rust or weather from such exposure.

During the winter, when the pool and pump and filter assembly are not in use, it is desirable to move the pump and filter assembly indoors to avoid harsh weather conditions. To move the filter, several lines or hoses must usually be disconnected, risking damage to the lines or the connecting means, especially in those cases where the connection means and/or lines or hoses are rusted or otherwise corroded. Additionally, pump and filter assemblies are frequently heavy and thus cumbersome and difficult to move. During the spring, when pump and filter assemblies which have been moved indoors are moved outdoors again, they are exposed to unpredictable weather from bright sunlight to heavy rain. Therefore, there exists a need for protective covers which can be used for such equipment.

Protective covers to prevent exposure of an item from the harmful effects of the weather are generally known. For example, U.S. Pat. No. 4,682,447 to Osborn shows a tarpaulin to be positioned and secured over an object to protect the object. This type of cover does not allow inspection of the object without loosening the securing means holding the tarpaulin in place. U.S. Pat. No. 4,206,575 to Leonard describes a cover which is specifically designed to be retrofit onto and permanently left in place on a mobile home, the cover having openings cut therein for windows and doors.

SUMMARY OF THE INVENTION

1. Objects Of The Invention

It is an object of the present invention to provide an easily installable and removable, seasonal protective cover for swimming pool pump and/or filter assemblies and/or heaters.

It is a further object of the present invention to provide a weather-resistant, protective cover for swimming pool pump and filter assemblies and/or heaters which when in place, avoids condensation of moisture or buildup of heat thereunder.

It is still another object of the present invention to provide a protective cover which not only can be readily and securely installed around a pump and/or filter assembly but also can be easily removed therefrom.

It is still another object of the present invention to provide a protective cover which allows inspection of a swimming pool pump and/or filter assembly without removing the cover or loosening the securing means which hold the cover in place.

Still another object is to provide a protective cover which can be custom-fit over a manufacturer's line of swimming pool pump and/or filter assemblies and/or pool heating assemblies.

These and other objects and advantages of the present invention will become readily apparent to those skilled in the art from the following description.

2. Brief Summary Of The Invention

The present invention accomplishes the above objects by providing a cover comprising a plurality of separate pieces which when assembled and joined to each other conform substantially to the shape of the swimming pool pump and/or filter assembly and/or pool heating assembly on which it is to be employed, the cover having a substantially weather-proof outer layer and being conveniently shaped to fit snugly over a swimming pool pump and filter assembly and/or heating assembly.

For illustrative purposes, the following description is limited to a protective cover for a swimming pool pump and filter assembly, but it is understood that one skilled in the art, based upon such description, could easily adapt the custom invention to other assemblies such as a swimming pool heater assembly.

The outer layer encloses substantially all of the pump and filter assembly. A mesh border extending below the base of the pump and filter assembly is provided along the bottom edge of the outer layer. The mesh border provides ventilation to prevent an excessive build up of moisture or heat under the cover. Securing means are provided in the mesh border to secure the cover in place. A sealable access means such as a zipper is provided in the weather-proof outer layer so that the cover can be opened to allow inspection of the pump and filter assembly without loosening the securing means.

In preferred embodiments, an insulating inner layer co-extensive with the substantially, weather-proof, outer layer may be provided to supply extra protection against freezing in severe cold weather, or over-heating in severe hot weather. In a further preferred embodiment, the securing means includes a draw-string structure which gathers together and pulls the mesh border slightly under the base of the pump and filter assembly.

DETAILED DESCRIPTION OF A PREFERRED EMBODIMENT

Figure 1:
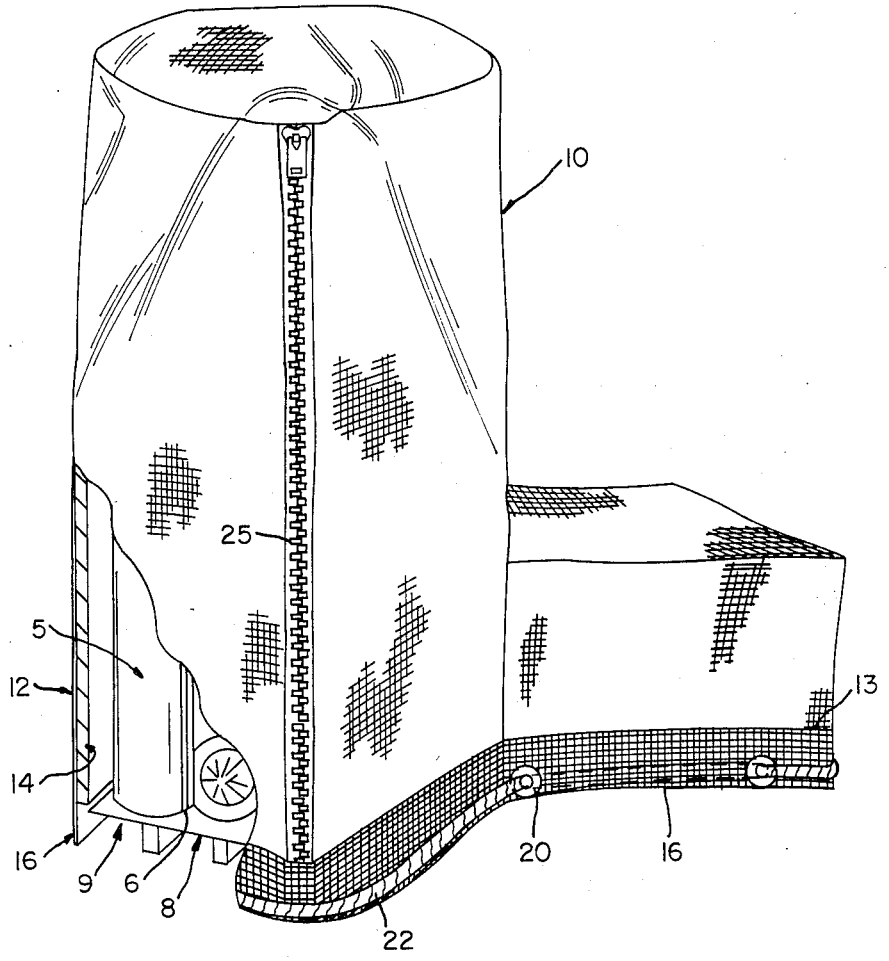
FIG. 1 is a perspective view of the protective cover of the present invention with a portion cut away to show the structure thereof and a portion of the pump and filter assembly covered thereby.

The cover of the present invention, generally denoted by the numeral 10, is appropriate for use with a swimming pool pump and filter assembly. The exact configuration of the pump and filter assembly 5 will govern the dimensions of the cover 10. Cover 10 comprises a plurality of pieces conveniently shaped so that when assembled the cover generally conforms substantially to and fits snugly over the swimming pool pump and filter assembly and/or heating assembly with which it is to be used. The number, size and shape of the separate pieces is selected so that the assembled cover essentially replicates the outer surface topography of a desired pump and filter assembly. The separate pieces conveniently may be sewn together securely or the like to form a unitary cover. The cover also includes a substantially weather proof, outer layer 12. Suitable materials for the weather proof outer layer 12 include canvas, marine vinyl and Gortex ®. The cover 10 including the outer layer 12 is placed over and fits snugly around the pump and filter assembly 5 to enclose substantially all of the pump and filter assembly 5. A mesh border 16 is affixed to the cover 10 in any convenient manner, such as by sewing, to the bottom edge 13 of the outer layer 12. The mesh border 16 encloses any portion of the pump and filter assembly 5 not enclosed by outer layer 12 and preferably extends below the base 6 of the pump and filter assembly 5. The material of construction of the mesh border 16 is not critical, as long as the mesh has openings therein through which moisture and heat can escape from under the cover 10. Typical suitable materials for the mesh border 16 include nylon mesh, vinyl mesh and the like.

The mesh border 16 has means for securing the cover 10 in place. In the preferred embodiment shown in FIG. 1, these securing means are grommets 20 located in the mesh border 16. Grommets 20 may be used to tie down the cover using rope or string which may be tied to stakes (not shown) hammered into the ground. As an additional or alternate securing means, a draw-string 22, typically extending generally parallel to the bottom edge of the mesh border 16 can be provided which, when pulled, will create gathers in the mesh border 16 and pull the mesh border 16 inwardly. A drawstring 22 is particularly appropriate where the base 6 of the pump and filter assembly 5 rests upon a support 8 of some sort, as shown in FIG. 1. The support 8 may be a platform, riser, skid or pallet or other type of support to keep the pump and filter assembly off of the ground. Preferably, support 8 has an overhang 9. When such a support 8 is present, pulling drawstring 22 will pull the mesh border 16 under overhang 9, providing a tighter enclosure around the pump and filter assembly 5.

One or more zipper(s) 25 are provided in the outer layer 12 to allow inspection of the pump and filter assembly 5 without loosening of the securing means. The zipper(s) 25 can be located at any desired portion of the cover 10. Preferably a zipper 25 is positioned over a component of the pump and filter assembly 5 which one might desire to monitor. By simply opening the zipper 25 and spreading apart the portions of cover 10 adjacent to the zipper, components of the pump and filter assembly 5 can periodically by visually inspected.

Where necessary or desired, an inner insulating layer 14 may be provided in the cover 10. The inner layer 14 is co-extensive with the outer layer 12, and provides insulation to protect the pump and filter assembly 5 from extreme heat or cold.

While only one preferred embodiment of the present invention has been described, it should be understood by those skilled in the art that various changes coming within the spirit of the invention may be suggested thereby. For example, various closure means other than zippers, e.g., Velcro ® fastening means, snap together button means, can be used. Hence, the invention is not limited to the specific embodiments shown or described and use mentioned, but the same is intended to be merely exemplary, the scope of the invention being limited only by the appended claims.

What is claimed is:

1. An easily installable and removable, substantially weather proof, protective cover adapted to protect a swimming pool pump and filter assembly, comprising:

a plurality of separate pieces which when assembled and joined to each other form a unitary body which conforms substantially to the shape of said swimming pool pump and filter assembly, said cover including a weather proof outer layer sized to fit snugly around and substantially enclose the pump and filter assembly;

a mesh border affixed to the bottom edge of said weather proof outer layer; and means located in said mesh border for securing the cover around the pump and filter assembly, whereby said swimming pool pump and filter assembly is protected from adverse weather conditions while at the same time permitting the escape of moisture and heat from under said cover.

2. A weather proof protective cover adapted to protect a swimming pool pump and filter assembly having a base which rests upon a platform, the cover comprising:

a plurality of separate pieces which when assembled and joined to each other form a unitary body which conforms substantially to the shape of said swimming pool pump and filter assembly, said cover including a weather proof outer layer sized to fit snugly around and enclose substantially the entire pump an filter assembly;

a mesh border affixed to the bottom edge of said weather proof outer layer, said mesh border extending below the base of the pump and filter assembly; and means located in said mesh border for securing the cover around the pump and filter assembly, whereby said swimming pool pump and filter assembly is protected from adverse weather conditions while at the same time permitting the escape of moisture and heat from under said cover.

3. The cover of claim 1 further comprising sealable access means in said outer layer providing access to the pump and filter assembly and which, when sealed, maintained the weather proof characters of said outer layer.

4. The cover of claim 3 wherein said sealable access means comprises a zipper on said outer layer.

5. The cover of claim 1 wherein said means for securing said cover to the pump and filter assembly comprises grommets located on said mesh border.

6. The cover of claim 1 wherein said means for securing said cover to the pump and filter assembly comprises a drawstring.

7. The cover of claim 1 further comprising an insulating inner layer co-extensive with said outer layer.

* * * * *